US006824415B2

(12) United States Patent
Wlos

(10) Patent No.: US 6,824,415 B2
(45) Date of Patent: Nov. 30, 2004

(54) COAXIAL CONNECTOR WITH SPRING LOADED COUPLING MECHANISM

(75) Inventor: James J. Wlos, Crete, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 10/004,460

(22) Filed: Nov. 1, 2001

(65) Prior Publication Data

US 2003/0082942 A1 May 1, 2003

(51) Int. Cl.[7] ..... H01R 4/24
(52) U.S. Cl. ..... 439/348
(58) Field of Search ..... 439/348, 352, 439/350, 346, 839, 583, 578, 584, 610

(56) References Cited

U.S. PATENT DOCUMENTS

| | | | | |
|---|---|---|---|---|
| 2,521,701 A | | 9/1950 | Coupling | 285/169 |
| 2,892,991 A | | 6/1959 | Beebee et al. | 339/91 |
| 2,933,712 A | | 4/1960 | Klopfenstein | 339/91 |
| 3,199,061 A | | 8/1965 | Johnson et al. | 339/100 |
| 3,458,850 A | | 7/1969 | Calisher | 339/45 |
| 3,509,515 A | | 4/1970 | Acord | 339/45 |
| 3,659,250 A | | 4/1972 | Horton | 339/91 B |
| 3,678,439 A | | 7/1972 | Vetter | 339/46 |
| 4,046,451 A | | 9/1977 | Juds et al. | 339/177 R |
| 4,407,529 A | | 10/1983 | Holman | 285/82 |
| 4,493,520 A | | 1/1985 | Davies | 339/91 P |
| 4,508,407 A | | 4/1985 | Ball | 339/89 R |
| 4,582,347 A | | 4/1986 | Wilcox et al. | 285/12 |
| 4,824,386 A | | 4/1989 | Souders | 439/133 |
| 4,846,714 A | | 7/1989 | Welsby et al. | 439/348 |
| 5,114,361 A | | 5/1992 | Houtteman | 439/348 |
| 5,137,470 A | | 8/1992 | Doles | 439/578 |
| 5,165,728 A | * | 11/1992 | Mayer | 285/12 |
| 5,167,533 A | | 12/1992 | Rauwolf | 439/583 |
| 5,334,051 A | | 8/1994 | Devine et al. | 439/583 |
| 5,354,217 A | | 10/1994 | Gabel et al. | 439/583 |
| 5,435,745 A | | 7/1995 | Booth | 439/584 |
| 5,595,502 A | | 1/1997 | Allison | 439/429 |
| 5,690,503 A | | 11/1997 | Konda et al. | 439/348 |
| 5,702,264 A | | 12/1997 | Endo et al. | 439/346 |
| 5,707,250 A | | 1/1998 | Smithson | 439/504 |
| 5,775,934 A | | 7/1998 | McCarthy | 439/427 |
| 5,795,188 A | | 8/1998 | Harwath | 439/583 |
| 5,802,710 A | | 9/1998 | Bufanda et al. | 29/828 |
| 5,803,750 A | | 9/1998 | Purington et al. | 439/17 |
| 5,807,129 A | | 9/1998 | Konda et al. | 439/348 |
| 5,934,937 A | | 8/1999 | McCarthy | 439/583 |
| 5,944,556 A | | 8/1999 | Wlos et al. | 439/583 |
| 5,984,709 A | | 11/1999 | Zink et al. | 439/348 |
| RE36,700 E | | 5/2000 | McCarthy | 439/427 |
| 6,062,897 A | | 5/2000 | McCarthy | 439/427 |
| 6,093,043 A | * | 7/2000 | Gray et al. | 439/352 |
| 6,109,964 A | | 8/2000 | Kooiman | 439/583 |
| 6,123,567 A | | 9/2000 | McCarthy | 439/427 |
| 6,302,447 B1 | * | 10/2001 | Lee | 285/86 |

* cited by examiner

*Primary Examiner*—P. Austin Bradley
*Assistant Examiner*—Phuongchi Nguyen
(74) *Attorney, Agent, or Firm*—Jenkens & Gilchrist

(57) ABSTRACT

A locking mechanism for a coaxial connector assembly of the type wherein an inner cylindrical connector member of a female connector is adapted for receipt within an outer connector member of a male connector. The locking mechanism is positionable between the male and female connectors and includes one or more locking balls disposed within a sleeve portion of the male connector. The sleeve is of the push-pull variety and incorporates an internal surface for biasing the locking ball or balls into a recess formed in the female connector. When the sleeve is in a locked position, the locking ball or balls captured therein are biased radially inwardly therefrom to urge the male and female connectors into a tighter engagement.

28 Claims, 10 Drawing Sheets

COAXIAL CONNECTOR WITH SPRING LOADED COUPLING MECHANISM

BACKGROUND OF THE INVENTION

1. Field of the Invention

The present invention relates generally to connectors for coaxial cables, and, more particularly, but not by way of limitation, to coupling mechanisms for coaxial cable connectors.

2. History of Related Art

A coaxial cable is generally characterized by having an inner conductor, an outer conductor, and an insulator between the inner and outer conductors. The inner conductor may be hollow or solid. At the end of coaxial cable, a connector is attached forming a coaxial cable assembly and facilitating mechanical and electrical coupling of the coaxial cable to electronic equipment and other cables. The method of and apparatus for the mechanical and electrical coupling of the connector to the coaxial cable has for a number of years been the subject of considerable design innovation. For example, to effectuate electrical contact between the inner contact of the connector and the inner conductor of the cable, the inner contact may be soldered or otherwise secured in some other fashion to the inner conductor. To effectuate electrical contact between the body member of the connector and the outer conductor of the cable, a myriad of design issues arise. One design issue relates to the configuration of the outer conductor of the cable. A connector for a coaxial cable having a helically corrugated outer conductor and a hollow, plain cylindrical inner conductor is, for example, described in U.S. Pat. No. 3,199,061 (Johnson et al.). The Johnson patent describes a self-tapping connector. Such connectors are time-consuming to install and relatively expensive to manufacture. Also, when the inner connector is made of brass, over-tightening causes the threads to strip off the connector rather than the end portion of the inner conductor of the cable, and thus the connector must be replaced.

More recent coaxial connector designs have addressed methods of and apparatus for quickly and easily attaching a connector to a coaxial cable with improved efficiency. U.S. Pat. No. 5,802,710, assigned to the assignee of the present invention, and incorporated herein by reference, teaches a method of attaching a connector to a coaxial cable that allows the depth of the inner contact relative to the body member of the connector to be easily controlled. In this manner, the depth of the inner contact relative to the body member of the connector is consistent from one assembly to the next. The method set forth therein also provides a moisture barrier between the cable and the connector without the use of rubber O-rings, thereby protecting the connector from detrimental environmental conditions.

It may thus be seen that coaxial connector designs must address multiple design aspects. U.S. Pat. No. 5,435,745 (Booth) describes a connector for coaxial cables also having a corrugated outer conductor. The Booth patent discloses a connector with utilizes a nut member which has a longitudinally slotted generally cylindrical barrel portion defining a number of barrel segments for fingers. The inner surface of the barrel segments or fingers are flat, so as to define a composite inner barrel surface which is hexagonal. A tapered bushing or inner surface of the connector engages the outer surface of the barrel and deforms the fingers defined by the slots of the barrel into contact with the corrugated outer conductor.

The need for improved high performance coaxial cable connectors that are easy and fast to install and uninstall, particularly under field conditions, has prompted further design innovation. For example, U.S. Pat. No. 6,109,964 (Kooiman), also assigned to the assignee of the present invention, and incorporated herein by reference, describes a connector assembly for a coaxial cable having an annularly corrugated outer conductor. The connector assembly further includes multiple ball bearings seated in apertures formed within the connector for capture between first and second body members thereof. This design minimizes the possibility of dropping and losing small parts, or making other assembly errors in the field when installing a coaxial connector to a coaxial cable. Such design aspects are critically important in the competitive communication industry where economy, reliability and efficiency are the subject of constant focus.

Another very important design aspect of coaxial connectors has been, and currently is, the coupling mechanism that facilitates an interlocking engagement between mating male and female coupling sections. For example, U.S. Pat. No. 4,508,407 (Ball) describes a connector for coaxial cables having a self-locking design wherein a plurality of balls are spring biased toward a locking ring which is rotatable with a coupling nut of the connector. The locking ring is formed with a circular array of detent recesses with which the balls engage when the coupling nut is rotated.

Another connector design addressing the coupling mechanism is set forth and shown in U.S. Pat. No. 4,493,520 to (Davies). The Davis patent describes a coaxial, push-pull connector utilizing balls sitting in an outside member and inwardly biased by a spring element. This particular design facilitates the mating of first and second connector members and their locking in the mating position. Likewise, U.S. Pat. No. 4,407,529 (Holman) teaches a self-locking coupling nut for electrical connectors. The design provides visual and tactile proof of the locked condition of the connector elements by utilizing a plurality of balls which are cammed into ball receiving grooves.

U.S. Pat. No. 4,824,386 (Souders) teaches a coaxial connector utilizing interlocking balls protruding into a recess of one of the connector members. A pair of ball sockets are formed in an inner casing with each containing a ball therein. A mating sleeve includes a pair of axial grooves which, when aligned with the ball sockets, permit the other one of the pair of mating connectors to be inserted and moved within the inner casing. When the axial grooves are offset in alignment from the ball sockets, the balls protrude into the inner casing hollow interior and retain the other mating connector in a selected one of two positions.

U.S. Pat. No. 5,114,361 to (Houtteman) teaches an arresting mechanism/lock for coaxial plug connectors. Balls are provided in a configuration wherein they are disposed in a protective sleeve and are kept in a locked position by a circularly bent spring that is locked in an outside surrounding flat groove of the protective sleeve. These and related designs exemplify the innovation in the effort for improved high performance coaxial cable connector couplings that are easy and fast to install and uninstall one to the other under field conditions and which may also be economically manufactured. The need for an improved locking mechanism for coupling mating cylindrical connector members of a coaxial connector yet remains. International design specifications have even been developed to establish uniformity. For example, one international harmonization system addressing uniform quality control for electronic components, including coaxial connectors, has been established by the Cenebec Electronic Components Committee ("CECC"), based in Europe.

It has been well established that connectors incorporating push-pull coupling assemblies permit faster installation than the threaded coupling assemblies. Typical push-pull couplings also often provide more reliable locking mechanisms because vibrations will have a less tendency to cause disconnection as compared to threaded connectors which are more prone to the deleterious effect of vibration. There are obviously no "cross-threading" problems with push-pull connectors, because such problems are by definition the problem of threaded engagement. Certain ones of these aspects are set forth in the above-referenced CECC standards.

It would be a distinct advantage to provide compliance with quality assurance standards, such as those of the CECC, with a push-pull coaxial connector locking mechanism providing efficient and reliable coupling of male and female connector members under field conditions. Enhanced coupling aspects provide improved reliability. The present invention provides such a reliable, push-pull coaxial connector coupling with a spring biased sleeve which is reciprocally positioned around an outer connector member. The push-pull connector described herein includes at least one locking ball therein positioned to be selectively capturable between an inner and outer cylindrical connector members such that it may be biased into secure engagement therein while providing both locked and unlocked positions therebetween.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION OF THE PREFERRED EMBODIMENTS

It has been discovered that a reciprocally mounted coupling nut constructed with an internal surface for inwardly biasing at least one locking ball into a recess of an inner cylindrical connector member of a coaxial connector can provide a myriad of advantages and improved reliability. The coupling nut of the coaxial connector of the present invention is constructed for inwardly biasing at least one, and preferably a plurality of locking balls into mating coupling members of the coaxial connector of the present invention. The interengagement of the locking ball with the coaxial coupling members of the present invention provides a tighter, more reliable connection with less contact resistance than conventional push-pull connectors.

Figure 1:
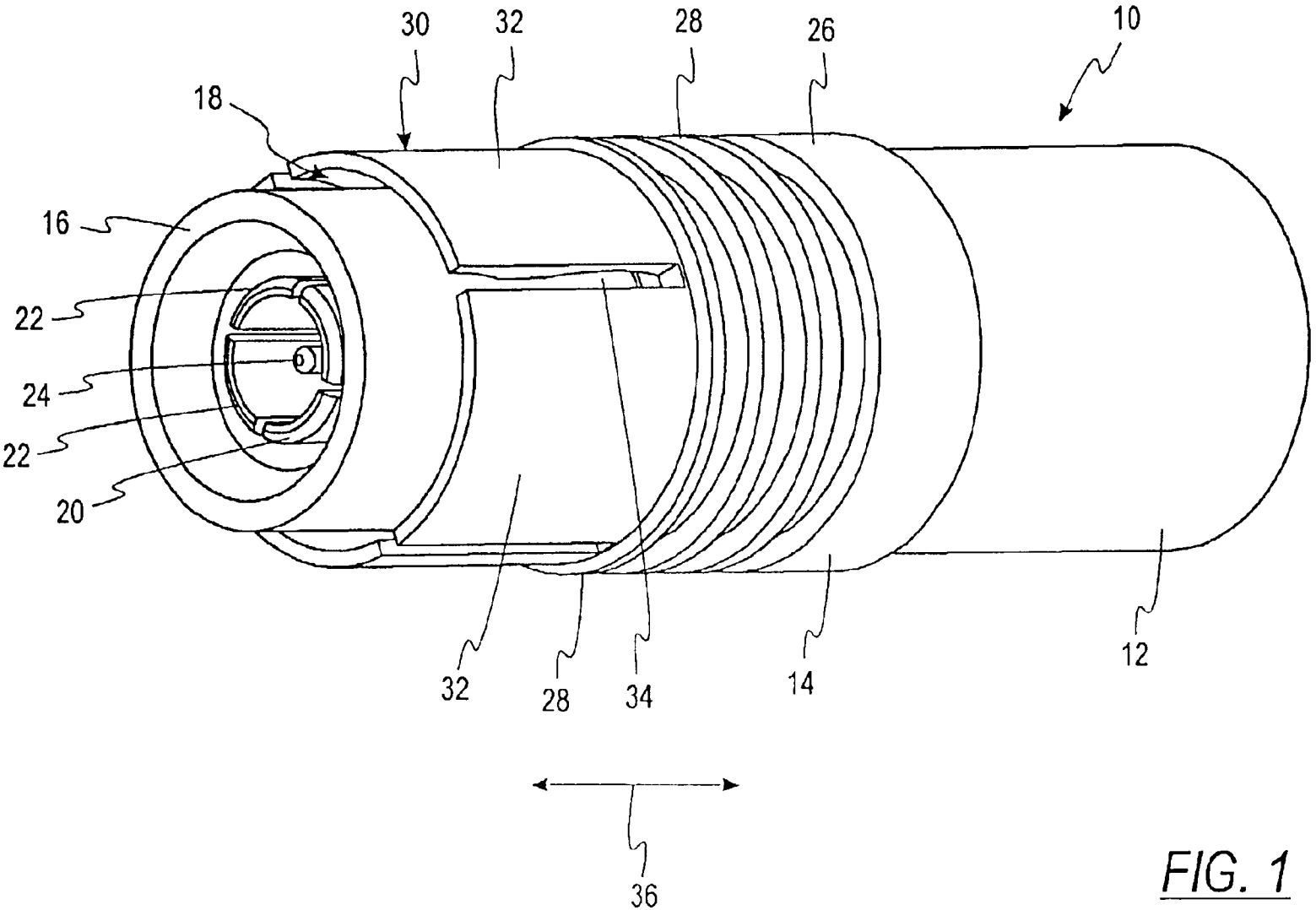
FIG. 1 is a perspective view of one embodiment of a male coaxial connector constructed in accordance with the principles of the present invention.

Referring first to FIG. 1 there is shown one embodiment of a male coaxial connector 10 constructed in accordance with the principles of the present invention. The connector 10 comprises a stationary sleeve 12 having a reciprocally positionable sleeve in the form of a coupling nut 14 mounted partially therearound. The coupling nut 14 is also reciprocally mounted around a cylindrical interface 16, which projects from a mating end 18 of coupling nut 14, and around outer contact 20. The outer contact 20 is shown to be coaxially positioned within the interface 16 and constructed of a plurality of segmented contact sections 22 surrounding a centrally disposed inner contact 24. This assembly will be referred to herein as a "male" connector when referring to the operation thereof discussed below.

Still referring to FIG. 1, the coupling nut 14 is constructed with a generally cylindrical body portion 26 having a plurality of external ribs 28 formed therearound and being contiguous to a segmented coupling section 30. Coupling section 30 is constructed of a plurality of segmented sections 32 formed therearound, functioning in part as "leaf" type springs, and having camming surface 34 formed therebeneath. In this particular embodiment, the coupling section 30 is slotted into four segments. Camming surface 34 will be described in more detail below as the leaf spring function provides a biasing force upon at least one, and preferably a plurality of steel balls (the positions of which may be seen more clearly in FIG. 2) as a result of the reciprocal actuation thereof as represented by arrow 36.

Figure 2:
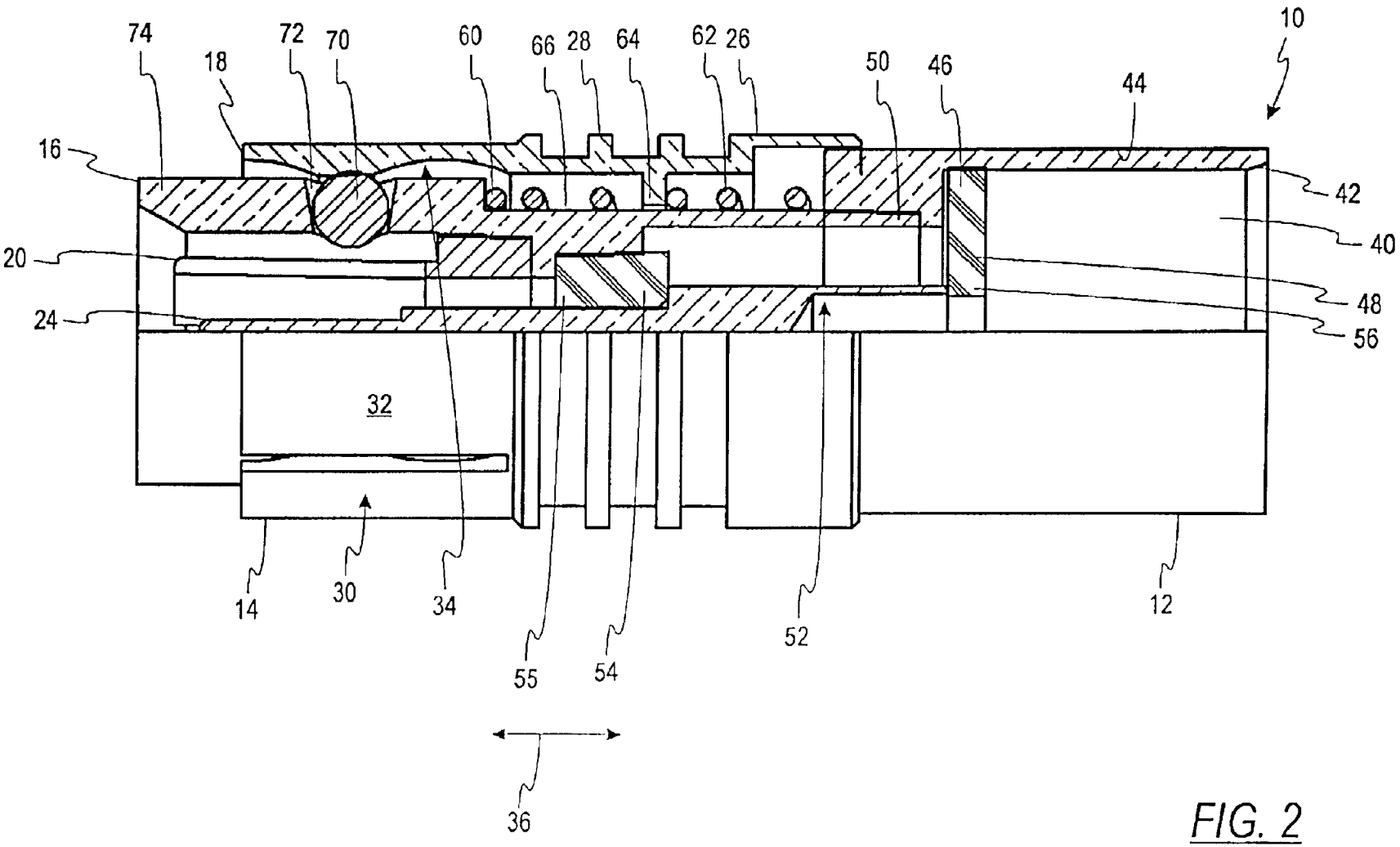
FIG. 2 is a side elevational, partially cross sectional view of the connector of FIG. 1 take along lines 2—2 thereof.

Referring now to FIG. 2, there is shown a side elevational, partially cross sectional view of the male connector 10 of FIG. 1 adapted for mating engagement with a standard type of female connector, as will be described below. The construction of the connector 10 may best be understood by review of the upper, cross sectional portion thereof, wherein sleeve 12 is shown to define a generally cylindrical hollow region 40 adapted to receive a coaxial cable therein. The hollow region 40 of sleeve 12 is defined by a first chamferred end 42, cylindrical side walls 44 and inner shoulder 46, against which a disk insulator 48 is secured. The sleeve 12 is constructed for receiving, in press fit interengagement therewith, end 50 of interface 16. Relative thereto, the sleeve 12 is constructed with an annular mating region 52 disposed inwardly of shoulder 46, said region 52 being adapted for receiving end 50 of interface 16 therein for structurally interconnecting said interface 16 and said sleeve 12 for the support of the other elements of the male connector disposed relative thereto.

Referring still to FIG. 2, the inner contact 24 is coaxially positioned within interface 16 by a first insulator 54 as will be described in more detail below. A second, disk insulator 56 is disposed within the hollow region 40 of sleeve 12 and positioned against shoulder 46 therein for dielectrically segregating the inner contact from the sleeve 12 and interface 16, as well as the coaxial cable (not shown) mounted therein. Within this assembled configuration, a first spring 60 is assembled between the interface 16 and the coupling nut 14 and separated from a second spring 62 by an intermediate bulkhead 64 extending radially inwardly as a part of coupling nut 14 facilitating rectilinear motion about cylindrical surface 66 of interface 16. As will be described in more detail below, the springs 60 and 62 bias the coupling nut 14 into a locking position relative to one or more a steel balls 70 mounted within aperture(s) 72 of coupling region 74 of interface 16.

Figure 3:
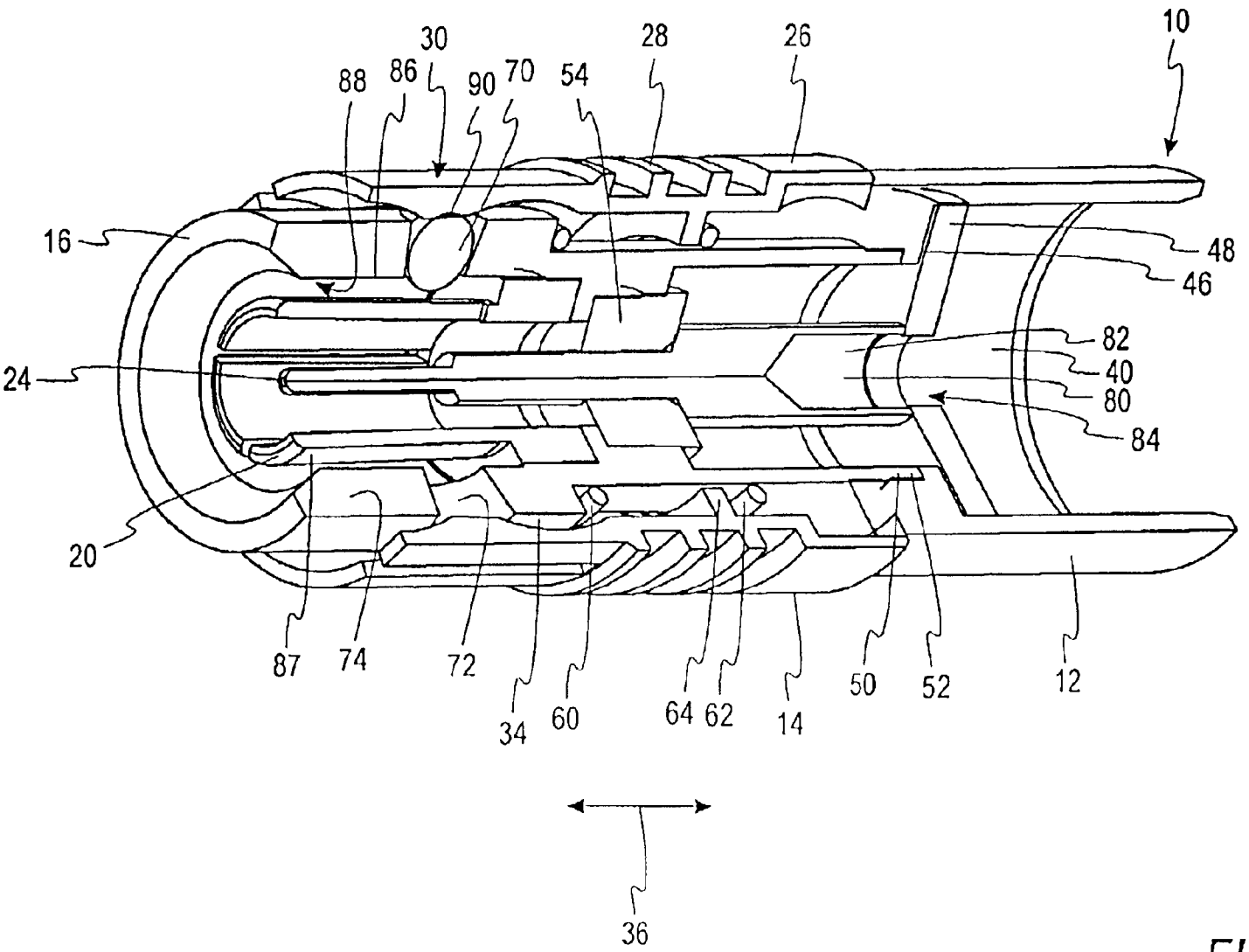
FIG. 3 is a partially cut away perspective view of the connector of FIG. 1 further illustrating the construction thereof.

Referring now to FIG. 3, there is shown a perspective, partially cut away view of the connector 10 of FIG. 1 further illustrating the construction thereof, initially described relative to FIG. 2 above. In this partially cut away perspective view it may be seen that the sleeve 12 is formed with mating region 52 having received end 50 of interface 16 therein. The disk insulator 48 is shown disposed against shoulder 46 of hollow region 40 of sleeve 12. A coaxial conductor connecting chamber 80 may be seen to be formed in end 82 of inner contact 24. Access to connecting chamber 80 is provided through aperture 84 formed in disk insulator 48. As described below, this assembly permits the assembly installation and mechanical and electrical connection of a coaxial cable to the connector 10.

Still referring to FIG. 3, the construction of the interface 16 and the assembly of at least one ball 70 therein is more clearly set forth and shown. In the embodiment of the invention set forth and disclosed herein, a series of three (3) balls 70, preferably formed of steel, are illustrated. The precise number of balls 70 may vary. In that regard, a ball receiving aperture 72 is shown to be formed in a tapering configuration within coupling region 74 of interface 16. The tapering configuration of aperture 72 is established to prevent the passage of ball 70 inwardly therethrough. The ball 70 does depend radially inwardly from a cylindrical underside 86 of interface 16 into annular female connector region 88 defined as that region between underside 86 and outer surface 87 of outer contact 20. The receipt and engagement of a female connector portion within annular female connector region 88 will be described in more detail below.

Referring still to FIG. 3, the position of insulator 54 about inner contact 24, coaxially received within interface 16 may also be more clearly seen and understood when taken in conjunction with the description of FIG. 2. Likewise, the reciprocal mounting of the coupling nut 14 radially outwardly of the interface 16 and axially positioned thereabout by springs 60 and 62 on opposite sides of bulkhead 64 may be further appreciated. The bulkhead 64 is integrally formed as a part of coupling nut 14, extending radially inwardly therefrom, oppositely of, and in generally parallel spaced relationship with, ribs 28 extending radially outwardly of cylindrical body portion 26 of the coupling nut 14. The ribs 28 facilitate manual engagement and the reciprocal movement of the coupling nut 14 in the direction of arrow 36 as described above. As referenced above, this reciprocal movement is biased into the position of coupling nut 14 shown herein by springs 60 and 62 which sandwich bulkhead 64 therebetween. Because the coupling section 30 is segmented into segments 32, each segment 32 forms a leaf spring about the camming surface 34 of coupling nut 14, effectively urging balls 70 radially inwardly by the spring biased, canning effect thereof. With the coupling nut 14 in the locking position shown herein, the ball 70 extend radially inwardly into annular female connector region 88. The ball 70 is secured in that position by locking surface 90 of camming surface 34 of the coupling nut 14. The camming surface 34 also tapers radially outwardly away from ball 70 on opposite sides of locking surface 90, and reciprocal movement of the coupling nut 14 relative to the interface 16 will permit balls 70 to be released from beneath locking surface 90 and move radially outwardly from annular female connecting region 88 to facilitate the receipt and/or release of a female connecting member.

Figure 4A:
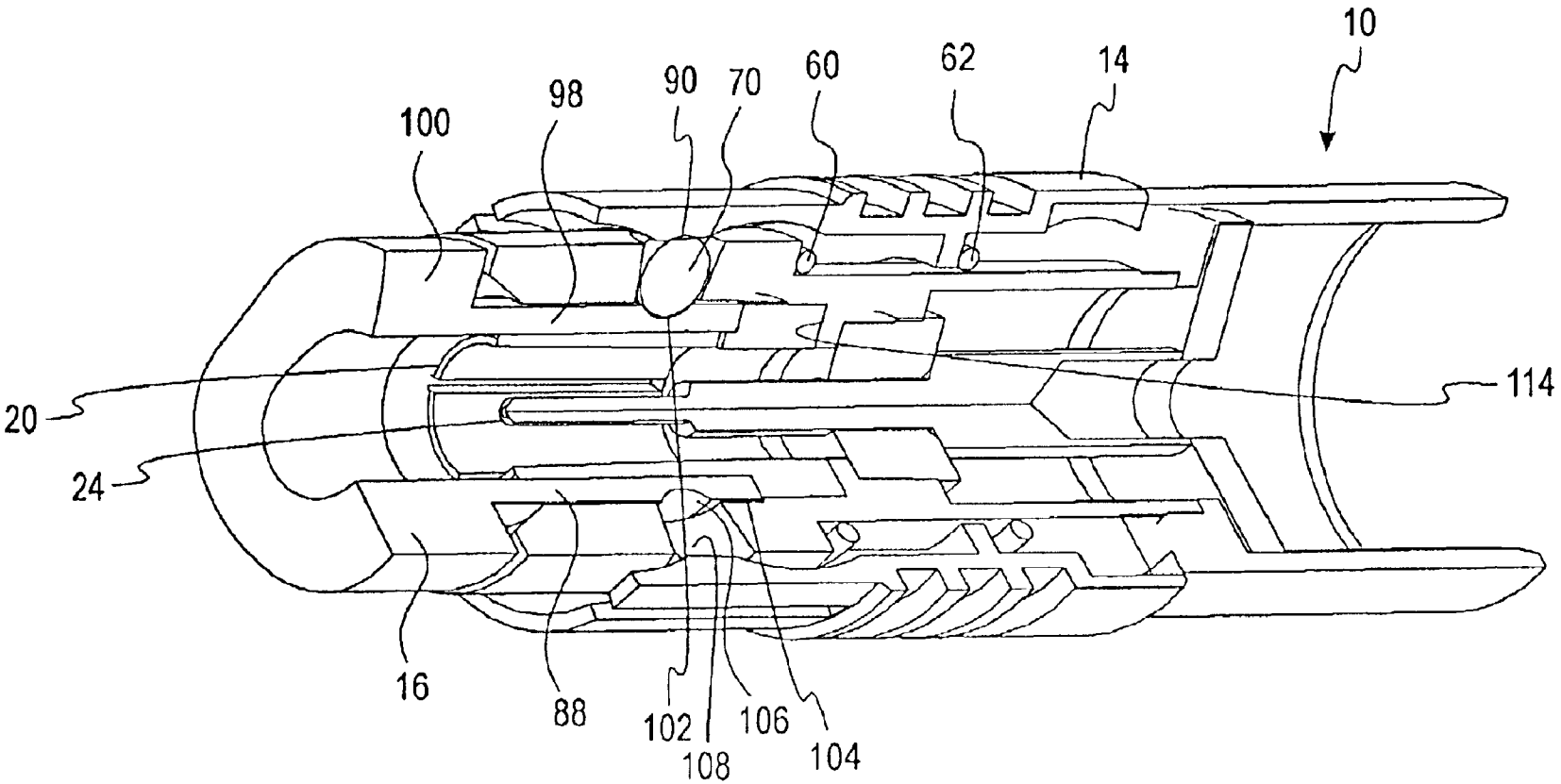
FIG. 4A is a partially cut away perspective view of the connector of FIG. 1 further illustrating the receipt of a portion of a female connector inserted therein to illustrate the operation thereof.
Figure 4B:
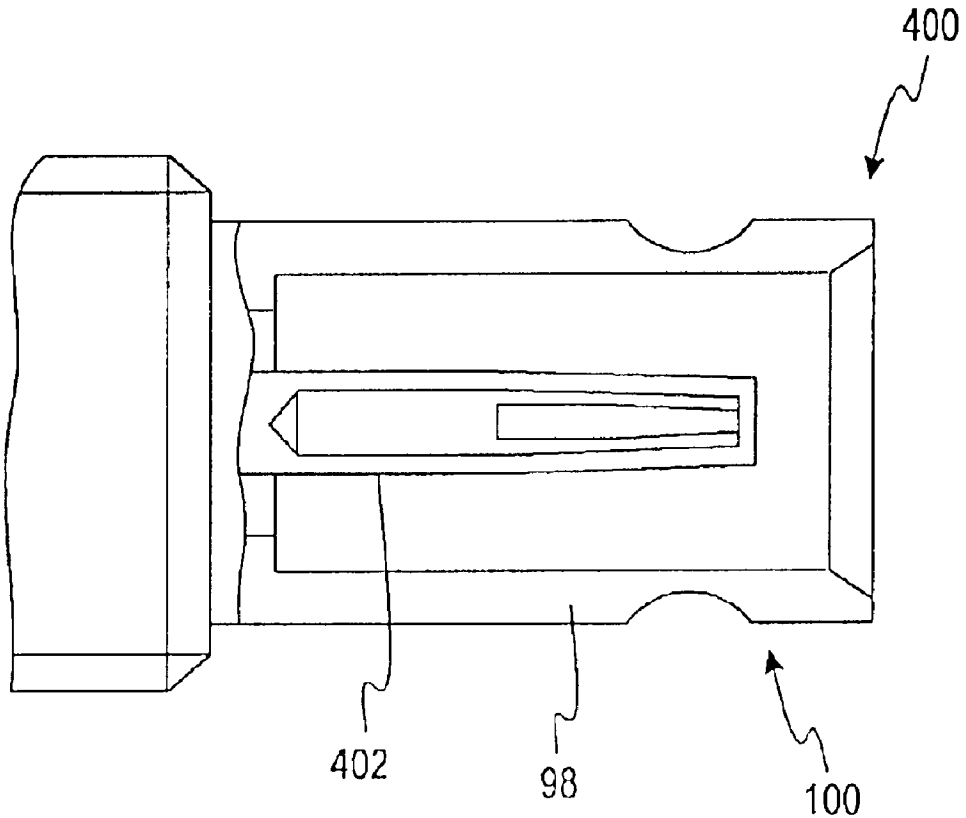
FIG. 4B is a drawing of a portion of a female connector as specified by and depicted in, specification of the CECC.

Referring now to FIG. 4A, there is shown the connector 10 of FIG. 3 with a cylindrical portion 98 of a female connector 100 axially received within annular female connector region 88 of male connector 10. The cylindrical portion 98 of female connector 100 illustrates the interengagement between the ball 70 of male connector 10 and the portion of female connector 100 adapted for mechanically and electrically connecting to the inner contact 24. It should be noted at this point in the description that the industry has promulgated standards for connectors such as the female connector 100 for interengagement of such connectors. As referenced above, the CECC has established connector standards, such as the shape and size of various portions of male and female, or "plug" and "jack," connectors. These terms are sometimes interchangeably used in the industry, and therefore it should be noted that the connector 10 of the present invention is referred to as the "male" connector. FIG. 4B is an illustration of such a standard and shows the construction of the coupling portion of the cylindrical portion 98 of the female connector 100 referenced herein.

Still referring to FIG. 4A, the cylindrical portion 98 of female connector 100 is constructed with a detent groove 102 formed in the surface 104 (also shown in the CECC standard of FIG. 4B). A lower portion 106 of the detent groove 104 is shown opposite aperture 108 formed in interface 16 wherein a ball 70 has been removed for purposes of illustration as in FIG. 3 above. It may be seen that in this position, the coupling nut 14 is axially positioned by springs 60 and 62 to position locking surface 90 of coupling nut 14 directly over ball 70 for urging said ball into the detent groove 102 of cylindrical portion 98 of female connector 100. In this locking position, the female connector 100 is secured within the male connector 10 for reliable electromechanical connection therewith.

Referring now to FIG. 4B, there is shown a drawing of a portion of a female connector, as specified by and depicted in specifications of the CECC referred to above. The drawing of the female connector illustrates one aspect of the standardization of such connectors. The female connector assembly 400, as shown herein, represents information set forth and shown in the CECC specifications and is referred to herein for purposes of illustration only. For example, a female resilient contact 402 is disposed concentrically within female connector 100 illustrated above, having cylindrical portion 98 referenced therein. Only reference to the portion of female connector 100 and the cylindrical portion 98 is discussed relative to the male connector 10 of the present invention. The illustration of and connectivity with the female resilient contact 402 comprising a portion of the female connector assembly 400 is not set forth and shown.

Figure 5:
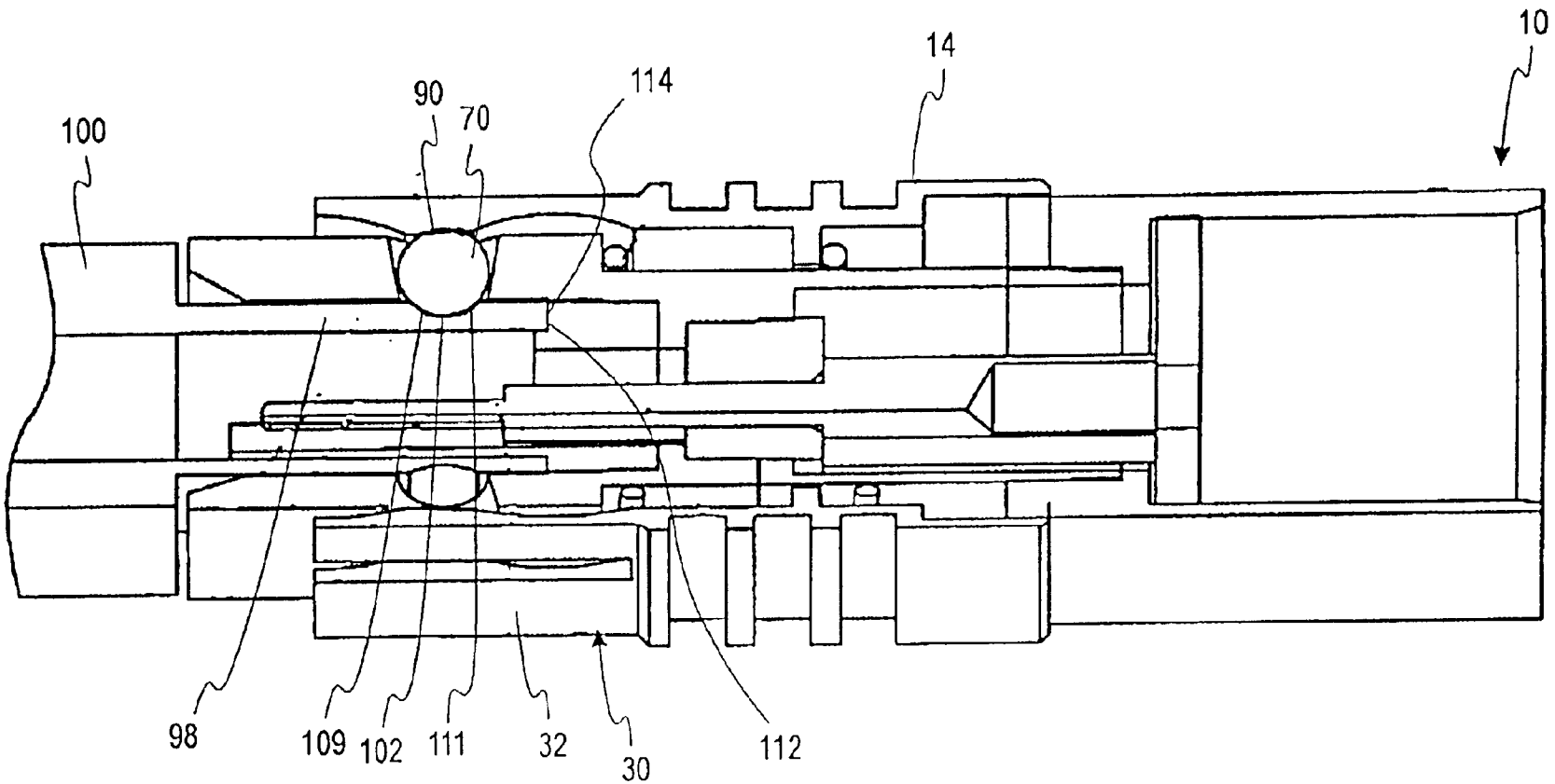
FIG. 5 is a side elevational view of the partially cut away connector of FIG. 4A.

Referring now to FIG. 5, there is shown a side elevational view of the cut away perspective view of FIG. 4A, illustrating in further detail the coupling of male connector 10 with a portion of a female connector 100. In this particular view, it may be seen that ball 70 extends radially inwardly from the locking surface 90 of coupling nut 14. The radially inwardly biasing force is, as referenced above, produced in part by the flexing of segments 32 of coupling section 30, which deflect to some degree radially outwardly when locking surface 90 is positioned upon ball 70 resting in detent groove 102. In this position, the ball 70 thus bears against the side walls 109 and 111 of the detent groove 102 for securing the cylindrical portion 98 in the position shown. Pressure against side wall 111 may be seen to urge distal end 112 of cylindrical portion 98 against a mating shoulder 114 of outer contact 20 (also shown in FIG. 4A). The radially inwardly biasing force of segment 32 of coupling nut 14 thus urges ball 70 against sidewall 111 of detent groove 102 to improve the interengagement between distal end 112 and shoulder 114 of outer contact 20 and enhance the electrical connection therebetween.

It may thus be seen that the present invention provides an advance over other coaxial cable conductors by providing enhanced electrical connectivity with quick and reliable interconnection between a male connector 10 and a female connector 100 through the reciprocal actuation of coupling nut 14. In the locked position discussed above wherein locking surface 90 of coupling nut 14 bears radially inwardly against ball 70, the female connector 100 is not only locked in position relative to male connector 10 but urged into a tighter electromechanical engagement therein to further facilitate the function thereof. Having thus described the assembly of the connector 10 of the present invention, reference will not be made to the following drawings illustrating the various parts referenced above.

Figure 6:
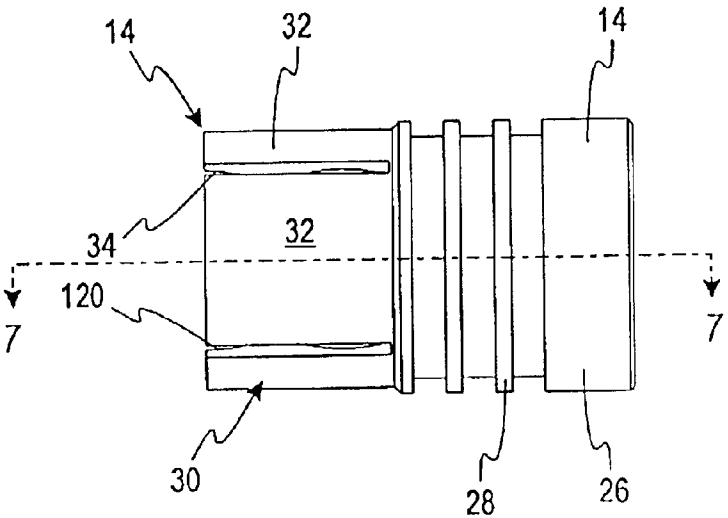
FIG. 6 is a side elevational view of the coupling nut of the connector of FIG. 1.

Referring now to FIG. 6 there is shown a side elevational view of the coupling nut 14 of FIG. 1. The four segments 32 of coupling nut 14 forming camming surface 34 are shown to be separated by slots 120 formed therebetween. Relative thereto, the underside of the camming surface 34 may also be seen in this view. It may also be seen that the coupling nut 14 (shown slotted into four segments) is of a single, unitary construction, although other manufacturing designs could be implemented.

Figure 7:
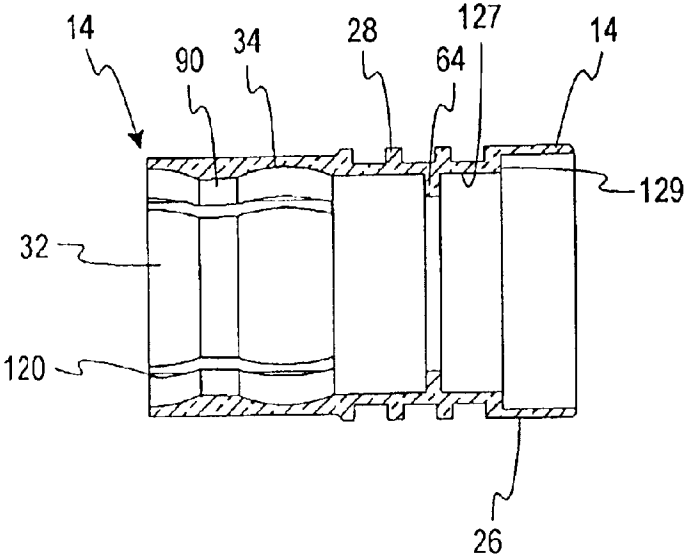
FIG. 7 is a side elevational, cross sectional view of the coupling nut of FIG. 6.

Referring now to FIG. 7 there is shown a side elevational cross sectional view of the coupling nut 14 of FIG. 6 taken along lines 7—7 thereof. In this particular view, the construction of the camming surface 34 of the coupling nut 14 is most clearly shown. Likewise, the locking surface 90 of camming surface 34 is also shown to be substantially planar in construction, as compared to the arcuate shape of the camming surface 34 on opposite sides thereof. Due to the arcuate shape of the camming surface 34, the lines defining slots 120 defining segments 32 are arcuate in shape, except for the portion thereof extending through substantially planar locking surface 90 of camming surface 34. The radially inwardly extending bulkhead 64 is also more clearly shown in its construction relative to ribs 28. Finally, it may be seen that the cylindrical underside 125 of cylindrical body portion 26 of coupling nut 14 forms a region which is larger in diameter than the contiguous cylindrical region 127 in order to facilitate the receipt of the sleeve 12 therewithin (shown most clearly in FIG. 2). It may likewise be seen that shoulder 129 is formed by cylindrical region 127. The shoulder 129 thus depends radially inwardly from cylindrical surface 125 to define a stop relative to the reciprocal actuation of coupling nut 14 as shown in FIG. 2.

Figure 8:
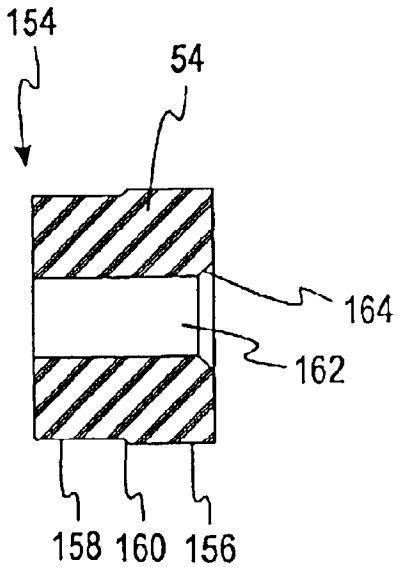
FIG. 8 is a side elevational, cross sectional view of the insulator of the connector of FIG. 2.

Referring now to FIG. 8, there is shown an enlarged, side-elevational cross-sectional view of the insulator 54 of FIG. 2. As shown herein, the insulator 54 is formed of generally solid insulative material having a stepped, cylindrical outer surface 154 comprising a first cylindrical portion 156 contiguous a second cylindrical portion 158, separated by a tapered transition section 160. A central aperture 162 is formed centrally therethrough and further includes a chamfered region 164. The construction of insulator 54 is designed to facilitate press fit insertion of the insulator 54 into the interface 16, as shown in FIG. 2. In this secured position against shoulder 55, shown in FIGS. 2 and 9, the insulator 54 is adapted to receive the inner contact 24 inserted therein, as shown in both FIGS. 2 and 3. The chamfered region 164 further facilitates the centering and insertion of said inner contact 24. It is well known in the industry to utilize rubber, plastic or the like as insulating material within coaxial connectors, and likewise the use of brass, copper and similar electrically-conducting material for the construction of the conducting portions of the male connector 10, as well as the female connector 100 (FIGS. 4 and 5).

Figure 9:
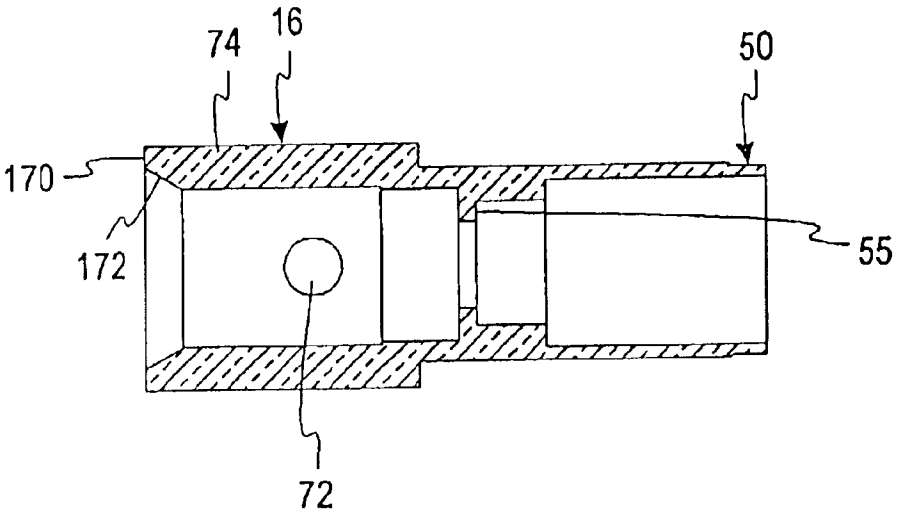
FIG. 9 is a side elevational, cross sectional view of the interface of the connector seen in partial cross section in FIG. 2.

Referring now to FIG. 9, there is shown an enlarged side-elevational, cross-sectional view of the interface 16 of FIG. 1 illustrating the construction thereof. Interface 16 is formed with at least one ball-receiving aperture 72 within a coupling region 74. Coupling end 170 of coupling region 74 includes a chamfer 172 to facilitate the introduction of the female connector (FIGS. 4 and 5) during the coupling thereof. The bulkhead 55 is likewise illustrated and adapted for receipt of the insulator 54 thereagainst (FIG. 2). The end 50 is also shown to be of reduced external diameter to further facilitate its introduction into the sleeve 12 (FIG. 2) and the press fit interengagement therewith, as described above.

Figure 10:
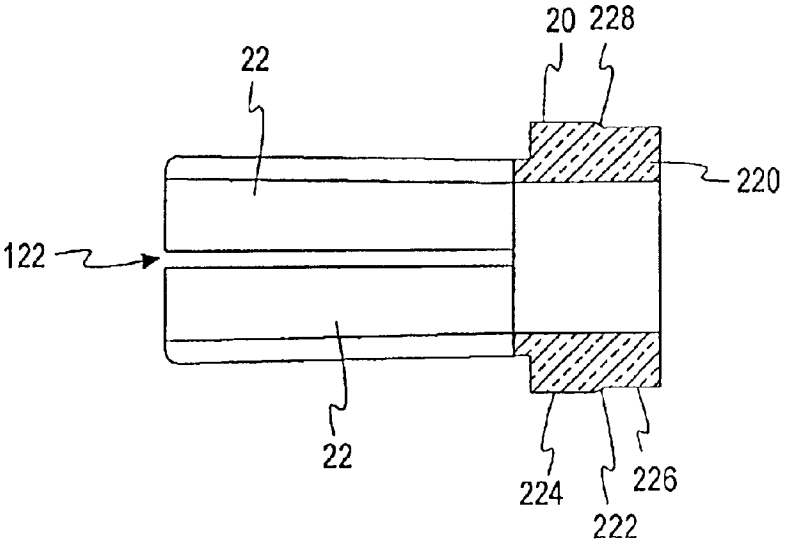
FIG. 10 is a side elevational, cross sectional view of the outer contact of the connector seen in partial cross section in FIG. 2.

Referring now to FIG. 10, there is shown an enlarged, side-elevational cross-sectional view of the outer contact 20 illustrating the construction thereof. The outer contact 20 includes a mounting bulkhead 220, having cylindrical outer surface 222 made up of a region 224 of larger diameter, and a contiguous region 226 of smaller diameter connected by a tapering transition region 228. The bulkhead 220 in the above-referenced cylindrical shape thereof is adapted for insertion into the interface 16 for secured seating therein. In this position, the outer contact 20 is adapted to receive a cylindrical portion 98 of the female connector 100, as shown in FIGS. 4A and 5. Segmented sections 22 of outer contact 20 are separated by slotted portions 122 to thereby facilitate a degree of flexing therewith upon the insertion of the female connector 100 (FIGS. 6, 4A and 5).

Figure 11:
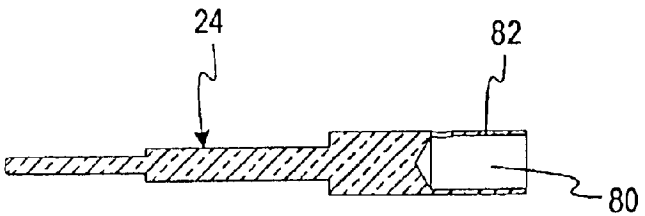
FIG. 11 is a side elevational cross sectional view of the inner contact of the connector of FIG. 1.

Referring now to FIG. 11, there is shown an enlarged, side-elevational, cross-sectional view of the inner contact 24 of FIG. 1, illustrating the construction thereof. Inner contact 24 is constructed with a conductor engaging chamber 80 having cylindrical side walls adapted for receiving a central conducting portion of a coaxial cable therein for secure mechanical engagement therewith and electrical contact thereto.

Figure 12:
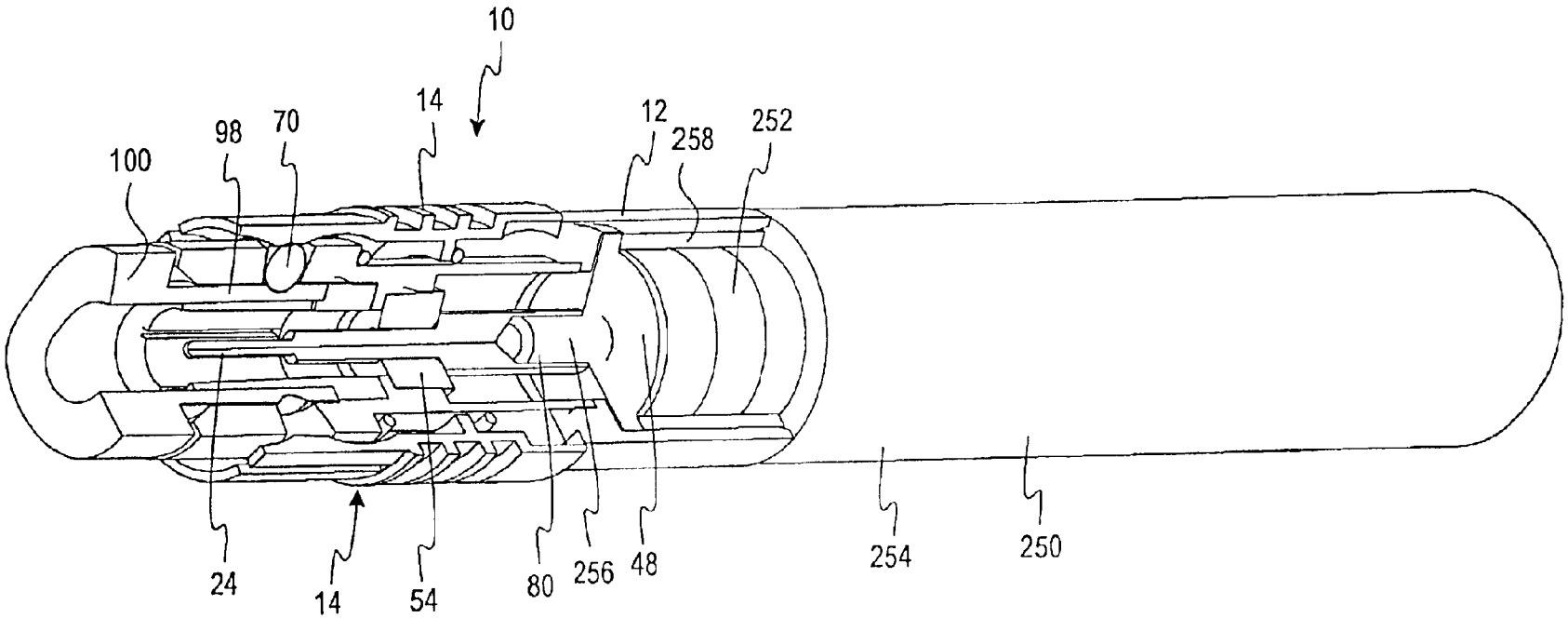
FIG. 12 is a partially cut away perspective view of the connector of FIG. 4A with coaxial cable secured thereto for illustrating further aspects of the assembly thereof.

Referring now to FIG. 12, there is shown a partially cut away perspective view of the connector 10 of FIG. 4A with a coaxial cable 250 secured thereto. Utilizing this figure, the preparation of a coaxial cable and the method of assembly of the connector 10 of the present invention with a coaxial cable will be set forth and shown.

Still referring to FIG. 12, a standard coaxial cable includes an inner conductor, an outer conductor, an insulator between the inner and outer conductors, and an insulative jacket. In the present illustration, coaxial cable 250 includes an outer conductor 252 shown, in this particular embodiment, to be of the corrugated variety. An insulative jacket 254 covers an outer conductor 252. The jacket 254 is shown removed in the region thereof extending within the connector 10. The exposed outer conductor 252 has wrapped thereover a solder ribbon 258, which is placed thereover prior to heating. An inner conductor 256 is shown protruding through the disk insulator 48 described above, which conductor 256 is soldered within the conductor connecting chamber 80 of inner contact 24. The inner contact 24 is shown axially aligned within the connector 10 by insulator 54 described above and, in this particular view, cylindrical portion 98 of female connector 100 has also been received in the connector 10, with ball 70 in engagement therewith.

In preparing the connector 10 for receipt of the coaxial cable 250, shown herein, it is typical in the industry to first "flush cut" the coaxial cable. The jacket 254 of the cable and the outer conductor 252 is next cut back to expose the inner conductor 256. In typical coaxial cables, a dielectric foam is disposed between the inner conductor 256 and the outer conductor 252 and said foam is likewise cut back to expose inner conductor 256. It is next necessary to remove a portion of the jacket 254 away from the outer conductor 252. This exposes the outer conductor 252 to the solder ribbon 258 to be placed therearound. The inner conductor is then inserted through the disk insulator 48 until it seats against the cut back portion of the remaining cable 250. The disk insulator 48 then serves as a spacer for locating inner contact 24 and as a sealing disk so that no solder will get into the connector 10 during the final soldering operation.

Still referring to FIG. 12, the next operational step is to solder the inner conductor 256 to the chamber 80 of inner contact 24. This may be effected by placing a small amount of solder in the chamber 80, heating it, so that the solder will melt and flow and then place the inner conductor 256 therein. By utilizing this technique, the entire connector 10 can be factory assembled. Moreover, by utilizing this configuration, the elements described above can be easily assembled. One aspect of the assembly is to position the requisite parts together as described above with the solder ribbon 258 placed around the outer conductor 252 and within the cylindrical sleeve 12 of coupling nut 14 whereby it may be heated to effectively secure the assembly. It has been found preferable to utilize an induction coil to melt the solder ribbon as set forth, shown and described in U.S. Pat. No. 5,802,710 assigned to the assignee of the present invention and incorporated herein by reference.

The previous description is of a preferred embodiment for implementing the invention, and the scope of the invention should not necessarily be limited by this description. The scope of the present invention is instead defined by the following claims.

What is claimed is:

1. A locking mechanism for coupling mating cylindrical connector members of a coaxial connector, said locking mechanism being positionable between said mating cylindrical connector members, said locking mechanism comprising:

at least one locking ball;

an outer cylindrical connector member having at least one ball receiving portion formed therein for receipt of said at least one locking ball, such that said at least one locking ball extends radially inwardly;

an inner cylindrical connector member having at least one recess formed therein for receipt of said at least one locking ball; and a slotted sleeve reciprocally positioned around said outer connector member, said sleeve having a plurality of flexible finger sections, at least one of said finger sections having an internal surface for directly contacting said at least one locking ball, said internal surface biasing said ball into said at least one recess of said inner cylindrical connector member such that when said sleeve is in a locked position, said ball is captured therein and biased radially inwardly therefrom and further wherein said sleeve is positionable into an unlocked position for releasing said at least one locking ball from said recess of said inner cylindrical connector member, said internal surface being fixed relative to said sleeve during said biasing of said at least one locking ball into said at least one recess of said inner cylindrical connector member, said internal surface preventing backlash of said ball during said locked position by applying a radial force in response to a radial deflection of a respective one of said finger sections.

2. The locking mechanism of claim 1 wherein portions of said locking ball extends through said ball receiving portion of said outer cylindrical connector member in position to bear against a surface of said at least one recess to urge said inner cylindrical connector member further into said outer cylindrical connector member.

3. The locking mechanism of claim 1, wherein said outer cylindrical connector member comprises a male connector member and said inner cylindrical connector member comprises a female connector member, and said male and female connector members are urged into connectivity by said inwardly biased locking ball when said sleeve is in said locked position.

4. The locking mechanism of claim 1, wherein said at least one locking ball includes at least three locking balls and said outer cylindrical connector member has at least three ball receiving portions.

5. The locking mechanism of claim 4, wherein said at least one recess of said inner cylindrical connector member comprises a groove formed around a portion of said inner cylindrical connector member.

6. The locking mechanism of claim 4 wherein said plurality of finger sections includes four finger sections.

7. The locking mechanism of claim 4, wherein said locking balls are larger than select regions of said ball receiving portions and are positioned on an outer surface of said outer cylindrical connector member, said internal surface of said sleeve forming a cam surface for engaging the outer portions of said locking balls urging said balls into said ball receiving portions.

8. The locking mechanism of claim 7, wherein said ball receiving portions of said outer cylindrical connector member are adapted for positioning in registry with said at least one recess of said inner cylindrical connector member.

9. A locking mechanism for a coaxial connector assembly of the type wherein an inner cylindrical connector member of a female connector is adapted for receipt within an outer connector member of a male connector, said inner cylindrical connector member having at least one recess formed therein, and wherein said locking mechanism is positionable between said male and female connectors, said locking mechanism comprising:

at least one locking ball;

said outer cylindrical connector member having at least one ball receiving portion formed therein for receipt of said at least one locking ball, such that said at least one locking ball extends radially inwardly; and a slotted sleeve reciprocally positioned around said outer connector member of said male connector, said sleeve having a plurality of flexible finger sections, at least one of said finger sections having an internal surface for directly contacting said at least one locking ball, said internal surface biasing said ball into said at least one recess of said inner cylindrical connector member when an inner cylindrical connector is received, such that when said sleeve is in a locked position, said locking ball is captured therein and biased radially inwardly therefrom and further wherein said sleeve is positionable into an unlocked position for releasing said at least one locking ball from said recess of said inner cylindrical connector member of said female connector, when said female connector is received, said internal surface being fixed relative to said sleeve during said biasing of said at least one locking ball into said at least one recess of said inner cylindrical connector member, said internal surface preventing backlash of said ball during said locked position by applying a radial force in response to a radial deflection of a respective one of said finger sections.

10. The locking mechanism of claim 9 wherein portions of said locking ball extends through said ball receiving portion of said outer cylindrical connector member in position to bear against a surface of said at least one recess to urge said inner cylindrical connector member further into said outer cylindrical connector member.

11. The locking mechanism of claim 9, wherein said at least one locking ball includes at least three locking balls and said outer cylindrical connector member has at least three ball receiving portions.

12. The locking mechanism of claim 11, wherein said at least one recess of said inner cylindrical connector member comprises a groove formed around a portion of said inner cylindrical connector member.

13. The locking mechanism of claim 11 wherein said plurality of finger sections includes four finger sections.

14. The locking mechanism of claim 11, wherein said locking balls are larger than select regions of said ball receiving portions and are positioned on an outer surface of said outer cylindrical connector member, said internal surface of said sleeve forming a cam surface for engaging the outer portions of said locking balls urging said balls into said ball receiving portions.

15. The locking mechanism of claim 14 wherein said ball receiving portions of said outer cylindrical connector member are adapted for positioning in registry with said at least one recess of said inner cylindrical connector member.

16. A method of unlocking the mating cylindrical connector members of a coaxial connector utilizing at least one locking ball, said mating cylindrical connector members comprising an outer cylindrical connector member and an inner cylindrical connector member having at least one recess formed therein, said method comprising the steps of:

positioning at least one locking ball in at least one ball receiving portion formed in said outer cylindrical connector member, such that said at least one locking ball extends radially inwardly therefrom;

reciprocally positioning a slotted sleeve around said outer connector member, said sleeve having a plurality of flexible finger sections, at least one of said finger sections having an internal surface for directly contacting said at least one locking ball, said internal surface biasing said ball into said at least one recess of said inner cylindrical connector member such that when said sleeve is in a locked position, said ball is captured therein and is biased radially inwardly therefrom; and positioning said internal surface of said sleeve into an unlocked position for releasing said at least one locking ball from said at least one recess of said inner cylindrical connector member, said internal surface being fixed relative to said sleeve during said biasing of said at least one locking ball into said at least one recess of said inner cylindrical connector member, said internal surface preventing backlash of said ball during said locked position by applying a radial force in response to a radial deflection of a respective one of said finger sections.

17. The method of unlocking mating cylindrical connector members of claim 16 and further including the step of biasing said sleeve relative to said outer connector member such that said sleeve is positioned in said locked position.

18. The method of unlocking mating cylindrical connector members of claim 16 and further including the steps of projecting portions of said at least one locking ball through said ball receiving portion of said outer cylindrical connector member in position to bear against a surface of said at least one recess to urge said inner cylindrical connector member further into said outer cylindrical connector member.

19. The method of unlocking mating cylindrical connector members of claim 16 and further including the steps of assembling said outer cylindrical connector member as a male connector member and assembling said inner cylindrical connector member as a female connector member, and urging said male and female connector members into connectivity with one another by said inwardly biased locking ball when said sleeve is in said locked position.

20. The method of unlocking mating cylindrical connector members of claim 16, wherein said step of positioning at least one locking ball includes the step of positioning at least three locking balls.

21. The method of unlocking mating cylindrical connector members of claim 20 and further including the step of disposing said internal surface of said sleeve to form a cam surface for engaging said balls and into said at least one recess.

22. The method of unlocking mating cylindrical connector members of claim 21 wherein said step of reciprocally positioning a slotted sleeve includes reciprocally positioning said sleeve such that said finger sections of said sleeve have a camming region for biasing said locking balls into said at least one recess of said inner cylindrical connector member.

23. A method of assembling a male coaxial connector for mating with a female coaxial connector utilizing at least one locking ball, said female connector being of the type having an inner cylindrical connector member with at least one recess formed therein, said method comprising the steps of:

providing said male connector with an outer cylindrical connector member having a diameter greater than the diameter of said inner cylindrical connector member;

positioning said at least one locking ball in at least one ball receiving portion formed in said outer cylindrical connector member, such that said at least one locking ball extends radially inwardly therefrom;

providing a slotted sleeve having a plurality of flexible finger sections, at least one of said finger sections having an internal surface for directly contacting said at least one locking ball, said internal surface biasing said ball into said at least one recess of said inner cylindrical connector member; and reciprocally positioning said sleeve around said outer connector member such that when said sleeve is in a locked position, said ball is captured therein and is biased radially inwardly therefrom, said internal surface being fixed relative to said sleeve during said biasing of said at least one locking ball into said at least one recess of said inner cylindrical connector member, said internal surface preventing backlash of said ball during said locked position by applying a radial force in response to a radial deflection of a respective one of said finger sections.

24. The method of assembling a male coaxial connector of claim 23 and further including the step of biasing said sleeve relative to said outer connector member such that said sleeve is positioned in said locked position.

25. The method of assembling a male coaxial connector of claim 23 and further including the steps of projecting portions of said at least one locking ball through said ball receiving portion of said outer cylindrical connector member and allowing said at least one locking ball to bear against a surface of said at least one recess to urge said inner cylindrical connector member further into said outer cylindrical connector member.

26. The method of assembling a male coaxial connector of claim 23 herein said step of positioning at least one locking ball includes the step of positioning at least three locking balls.

27. The method of assembling a male coaxial connector of claim 26 and further including the step of disposing said internal surface of said sleeve to form a cam surface for engaging said balls and urging said balls into said at least one recess.

28. The method of assembling a male coaxial connector of claim 27 wherein said step of reciprocally positioning a slotted sleeve includes reciprocally positioning said sleeve such that said finger sections of said sleeve have a camming region for biasing said locking balls into said at least one recess of said inner cylindrical connector members.

* * * * *